United States Patent [19]

Weyn

[11] 3,936,000

[45] Feb. 3, 1976

[54] DEPRESSIBLE AEROSOL SPRAY ACTUATING CONFINING DEVICE

[75] Inventor: Hendrik Frans Weyn, Le Chesnay, France

[73] Assignee: Colgate-Palmolive Company, New York, N.Y.

[22] Filed: Nov. 18, 1974

[21] Appl. No.: 524,516

[30] Foreign Application Priority Data

Dec. 19, 1973 France ..... 73.45491

[52] U.S. Cl. ..... 239/288.5; 222/182; 222/402.13

[51] Int. Cl.² ..... B05B 1/28; B05B 15/04

[58] Field of Search ..... 239/288, 288.3, 288.5; 222/182, 402.13

[56] References Cited

UNITED STATES PATENTS

| | | | |
|---|---|---|---|
| 3,012,555 | 12/1961 | Meshberg | 222/402.13 X |
| 3,254,803 | 6/1966 | Meshberg | 222/182 |
| 3,306,252 | 2/1967 | Knight et al. | 222/182 X |
| 3,347,423 | 10/1967 | Rahn et al. | 222/402.13 X |
| 3,450,299 | 6/1969 | Barbera | 222/182 X |
| 3,738,537 | 6/1973 | Gach | 222/402.13 X |
| 3,756,514 | 9/1973 | Brown | 239/288.5 X |
| 3,841,533 | 10/1974 | Carroll et al. | 222/402.13 |

*Primary Examiner*—Robert S. Ward, Jr.
*Attorney, Agent, or Firm*—Herbert S. Sylvester; Murray M. Grill; Norman Blumenkopf

[57] ABSTRACT

A shield device for restricting the spray from an aerosol container to a limited area used in applying an antiperspirant or deodorant to the axilla, which includes a sleeve releasably coupled to the top of and projecting above an aerosol container having an axial upwardly directed nozzle and a concentric depressible valve actuator. A frustoconical tubular shield member is coaxially supported by the sleeve for downward movement to depress the valve actuator, and projects above the sleeve and is releasably lockable in its raised position. By pressing the upper edge of the shield member against the axilla, the valve is depressed and opened.

6 Claims, 6 Drawing Figures

DEPRESSIBLE AEROSOL SPRAY ACTUATING CONFINING DEVICE

The present invention relates generally to improvements in aerosol spray devices, and more particularly to an improved device for use with a pressurized aerosol container provided with a valved nozzle, for confining the aerosol spray to a limited region, and for facilitating the actuation of the aerosol valve.

A widely employed and highly convenient procedure for applying a material to a surface is achieved by packaging the material in a liquid or finely divided state dissolved or dispersed in a highly volatile propellant, for example, the fluorinated hydrocarbons such as Freon, in a container having a valved spray nozzle. The nozzle is directed toward the surface to be treated and the valve opened to produce a spray of the propellant and material which deposits on the surface with the prompt evaporation of the propellant. While the above procedure has many advantages, when employed in applying a material to part of the person, as when an antiperspirant or deodorant is applied to the axilla or armpit with the use of the conventional aerosol spray devices, substantial overspray occurs, that is, a portion of the material bearing spray escapes into the surrounding atmosphere and deposits on surfaces remote from the axilla. This is both wasteful and inefficient.

Accordingly, among the principal objects of the present invention is to provide an improved spray device for confining an aerosol spray.

Still another object of the present invention is to provide an improved spray confining shield for use with a pressurized aerosol container.

A further object of the present invention is to provide an improved aerosol spray confining shield for use with pressurized aerosol containers which facilitate the actuation of the container valve attendent to the positioning of the device.

Still a further object of the present invention is to provide an improved aerosol spray confining shield for facilitating the application of the spray to the axilla.

Another object of the present invention is to provide a device of the above nature characterized by its simplicity, low cost, reliability, ease and convenience of use and high versatility and adaptability.

The above and other objects of the present invention will become apparent from a reading of the following description taken in conjunction with the accompanying drawing which illustrates preferred embodiments thereof.

The present invention contemplates the provision of an aerosol confining device for use with a pressurized aerosol container provided on its top wall with an axially, upwardly directed spray nozzle and a valve which is opened by the depression of a valve actuator located near the spray nozzle. The device comprises a longitudinally extending tubular shield member separably supported on the top of the aerosol container for longitudinal movement to an advanced position depressing the actuator to open the valve, and a retracted position releasing the actuator to close the valve.

According to a preferred form of the improved device, there is provided a sleeve member separably coupled to the upper part of the container. The shield member is of frustoconical configuration and coaxially registers with the sleeve with its upper end above the top of the sleeve and its lower, contracted end registering with the valve actuator which is of annular shape concentric with the spray nozzle. Guide means are provided on the inside face of the sleeve to maintain the sleeve and shield member in coaxial relationship, and cooperating means are located on the confronting faces of the shield member and sleeve for releasably locking the shield member in its retracted position.

The improved spray device is simple and convenient to use, is highly effective in confining the aerosol spray to the desired area and is employed to great advantage for application of antiperspirant and deodorant sprays to the axilla.

Figure 1:
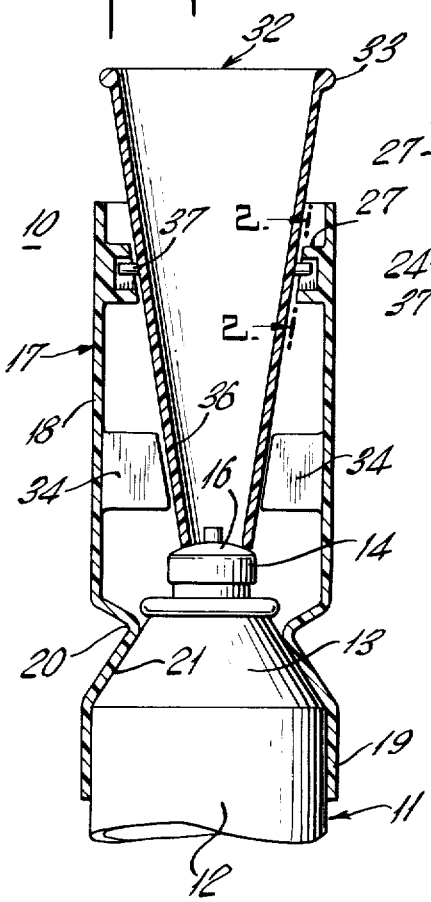
FIG. 1 is a fragmentary front elevational view partially in medial vertical section of a preferred embodiment of the present invention.
Figure 2:
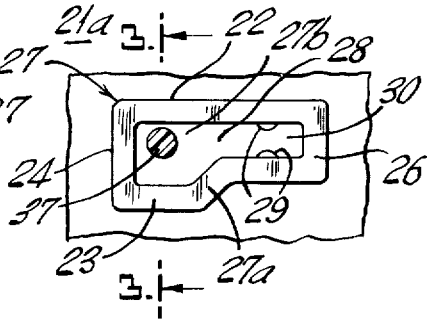
FIG. 2 is an enlarged sectional view taken along line 2—2 in FIG. 1.
Figure 3:
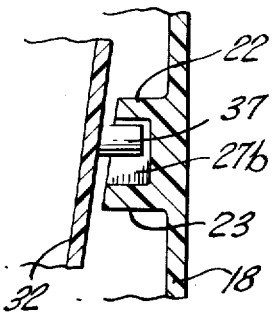
FIG. 3 is a sectional view taken along line 3—3 in FIG. 2.

Referring now to the drawing, particularly FIGS. 1 to 3 thereof, which illustrate a preferred embodiment of the present invention, the reference numeral 10 generally designates the improved valve actuating and aerosol spray confining device illustrated as applied to an aerosol container 11. The aerosol container is of conventional construction and includes a cylindrical body 12 joining an upper portion 13 which is curved and converges to a top wall, and forms an upwardly and inwardly inclined shoulder. An upwardly directed spray nozzle is coaxially positioned on the container top wall and communicates by way of a spring closed valve with the bottom of the container 11 by way of a dip tube. Associated with the aerosol valve is an annular valve actuator 14 which may have a slightly upwardly convex top face 16 as shown. The depression of valve actuator 14 by pressure on its top face 16 effects the opening of the spray valve. The container 11 is charged with any desirable material, for example, a suitable antiperspirant or deodorant composition carried in a Freon propellant.

The spray confining device 10 includes a container coupling and guide support sleeve 17 which is advantageously formed of a resilient organic polymeric resin, such as a polyolefin, for example, polyethylene or polypropylene, polyvinyl chloride or the like. The sleeve 17 is of approximately the diameter of the container 11 and is divided into an upper or main section 18 and a lower or coupling section 19 by an inwardly projecting annular ridge 20 having a downwardly facing inside shoulder 21 complementing a portion of the container section 13. In the applied position, the sleeve coupling section 19 detachably and snugly engages container body 12 with the sleeve shoulder 21 bearing on container portion 13, and the sleeve main section 18 projecting coaxially above the container 11.

Formed on the inside face of the upper border of sleeve 17 are a pair of similarly shaped, diametrically opposed, inwardly projecting, peripherally extending, locking and guide sections 27. Each of the sections 27 comprises a peripheral wall which includes upper and lower horizontal parallel legs 22 and 23 respectively, the upper leg being longer than the lower leg, a long vertical end leg 24 and a short upper vertical end leg 26, the proximate ends of legs 23 and 26 being joined by an angular leg 27*a* provided with a lower inclined portion and an upper horizontal portion. The peripheral walls of the sections 27 each delineate a main enlarged recess 27*b* extending vertically and horizontally and joined at an upper corner by an upper horizontal passageway 28 provided, proximate its outer end, with a pair of opposing projections 29 which delineates a locking recess 30.

Coaxially registering with the upper sleeve section 18 is a frustoconical tubular shield member 32, which may be formed of the same material as sleeve 17, and which is open at its top and bottom. The upper or enlarged end of shield member 32 is above the level of sleeve 18, is of approximately the same diameter thereof, and is beaded or rounded as at 33. The lower or reduced end of shield member 32 is of a diameter somewhat less than that of the valve actuator face 16 and is adapted to concentrically bear thereon. In order to maintain the shield member 32 and sleeve 17 coaxial, a plurality of circumferentially spaced, inwardly directed, radial vanes 34 project from the sleeve section 18 proximate the lower part of shield member 32 and terminate in inclined inner edges which are parallel to, and closely spaced from, the outer wall of shield member 32.

A pair of diametrically opposing radial pins 37 project outwardly from shield member 32 into registry with recesses 27b and are of slightly less diameter than passageway 28. The pins 37, sections 27, sleeve 17, and shield member 32 are so dimensioned and related that when the device 10 and container 11 are in assembled condition and the pins 37 register with recesses 27*b*, the section legs 23 permit the depression of the shield member 32 sufficiently to depress the actuator 14 to a valve open position and the legs 22 prevent the separation of shield member 32 from sleeve 17; and when the pins 37 engage passageways 28, the sleeve member 32 is prevented from depressing valve actuator 14.

Considering now the use and operation of the improved aerosol spray confining and valve actuating device 10, the coupling section 19 of sleeve 17 is slipped over the nozzle end of container 11 until ridge shoulder 21 bears on the container portion 13, as shown in FIG. 1. The shield member 32 is then twisted counterclockwise in sleeve 17, as viewed from the top, to bring pins 37 into registry with recesses 27*b* and the device is now in condition for use.

The upper edge 33 of the shield member 32 is then pressed against the surface to be sprayed, for example, in the case of an antiperspirant or deodorant against the axilla surface, to confine a predetermined area of the surface and to depress the valve actuator 14 by reason of the pressure thereon by the bottom edge of shield member 32. The valve is consequently opened to release an aerosol spray which is confined to the axilla, or other, area. It should be noted that the shield upper edge 33 may be of undulate configuration to mate the corresponding contour of the axilla surface. Following the spraying of the axilla, and in order to store the assembly in a condition where the accidental opening of the valve is obviated, the raised shield 32 is turned clockwise in the sleeve 17 to urge the pins 37 along passageways 28 past the projections 29 and into engagement with the terminal recesses 30.

Figure 4:
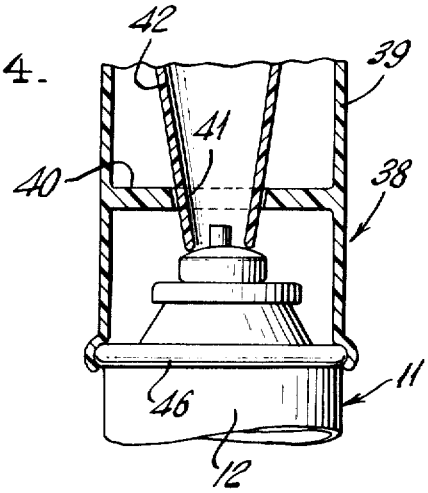
FIG. 4 is a fragmentary vertical medial sectional view of a detail of another embodiment of the present invention.

The embodiment of the present invention illustrated in FIG. 4 of the drawing differs from that first described in the structure which maintains the depressible shield member and sleeve in a coaxial relationship. Specifically, the mounting and coupling sleeve 38, which corresponds to sleeve 17 includes an upper portion 39 corresponding to sleeve portion 18. Instead of the vanes 34, there is provided on the lower inside face of sleeve portion 39 an annular member 40 integrally formed with sleeve 38 and having a conical inner peripheral face 41 parallel to, and spaced from, the outer face of the frustoconical shield 42 which is axially, slidably supported by sleeve 38 in the manner of sleeve 17 and shield member 32. In all other respects, and in operation, the devices of FIGS. 1 and 4 are similar.

Figure 5:
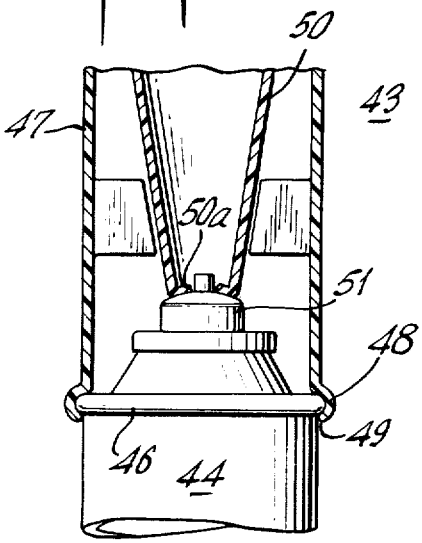
FIG. 5 is a view similar to FIG. 1 of a further embodiment of the present invention.

In FIG. 5 of the drawing, there is illustrated another embodiment of the present invention which is modified for use with an aerosol container of different construction than that shown in FIG. 1. The spray confining device 43 is employed with an aerosol container 44 of cylindrical configuration and provided at its upper edge with a peripheral bead 46. The device 43 includes a sleeve 47 similar in construction to the upper section 18 of sleeve 17 and provided at its bottom with a slightly outwardly offset, inwardly concave, depending peripheral wall 48 terminating in an inwardly, downwardly inclined lip 49. In other respects, the device 43, including the associated frustoconical shield 50 and the aerosol container 44 having an axial, upwardly directed nozzle and a concentric, valve actuating annulus 51 is similar to the device 10 and aerosol container 11 respectively, as described above. The bottom of cone 50, however, is shown as having an inwardly directed flange 50*a* to assist in resting cone 50 onto annulus 51. Such provision, as well as the use of an outwardly directed flange, or both, can be used with any of the embodiments hereof. The device 43 is coupled to the container 44 merely by pressing sleeve 47 downwardly onto the container 44 until the curved peripheral wall 48 snaps into engagement with the outer periphery of bead 46.

Figure 6:
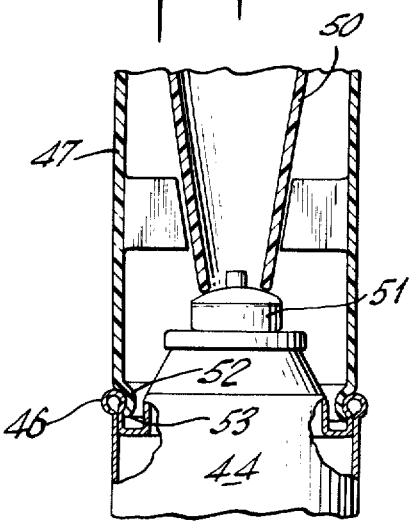
FIG. 6 is a view similar to FIG. 5 of a further embodiment of the present invention.

The embodiment shown in FIG. 6 differs from that shown in FIG. 5 only in that the coupling effected between the shield member and the aerosol container is by way of the inner under surface of the aerosol container bead 46. The sleeve 47 is provided at its bottom with a depending, inwardly offset, coaxial annular flange 52 having a concave outer face and terminating at its bottom in an outwardly directed peripheral lip 53. In assembling the container 44 and the sleeve 47, the sleeve is coaxially pressed downwardly on the container 44, the upper inside face of the bead 46 cams the lip 53 inwardly until the lip is lowered below the inner periphery of the bead 46 and the lip 53, is then resiliently urged outwardly to firmly engage the underface of the inner section of the bead 46.

While there have been described and illustrated preferred embodiments of the present invention, it is apparent that numerous additions, omissions, and alterations may be made without departing from the spirit thereof.

What is claimed is:

1. An aerosol spray confining device for use with a pressurized aerosol container provided on the top wall thereof with an axially directed spray nozzle, a valve, and a valve actuator which upon depression opens said valve, comprising a longitudinally extending tubular shield member and means for mounting said shield member on said container, in communication with said nozzle, for longitudinal movement between an advanced position engaging and depressing said valve actuator to open said valve and a retracted position releasing said actuator to a valve closed condition, said mounting means comprising a sleeve member having a lower end releasably engaging the upper end of said container and supporting said shield member coaxially with said container for movement between said advanced and retracted positions, said shield member projecting above said sleeve, said valve actuator including a depressible circular member coaxial with said nozzle and said shield member being of frustoconical configuration and coaxial with said sleeve with its reduced lower end registering with said valve actuator.

2. An aerosol spray confining device for use with a pressurized aerosol container provided on the top wall thereof with an axially directed spray nozzle, a valve, and a valve actuator which upon depression opens said valve, comprising a longitudinally extending tubular shield member and means for mounting said shield member on said container, in communication with said nozzle, for longitudinal movement between an advanced position engaging and depressing said valve actuator to open said valve and a retracted position releasing said actuator to a valve closed condition, said shield member being of frustoconical configuration with its reduced lower end directed toward said actuator.

3. The device of claim 1, including cooperative means in said shield member and sleeve for releasably locking said shield member in a retracted position.

4. The device of claim 1, including guide means positioned in the inside face of said sleeve for restricting the transverse movement of said shield member.

5. The device of claim 1, including means restraining the separation of said sleeve and said shield member.

6. The device of claim 1, including means on said sleeve restricting the telescoping of said sleeve and container.

* * * * *